US011175112B2

(12) United States Patent
Linderö

(10) Patent No.: US 11,175,112 B2
(45) Date of Patent: Nov. 16, 2021

(54) SIMULATION DEVICE AND A METHOD FOR FACILITATING SIMULATION OF A SHOT FROM A WEAPON

(71) Applicant: SAAB AB, Linköping (SE)

(72) Inventor: Björn Linderö, Huskvarna (SE)

(73) Assignee: SAAB AB, Linköping (SE)

( * ) Notice: Subject to any disclaimer, the term of this patent is extended or adjusted under 35 U.S.C. 154(b) by 239 days.

(21) Appl. No.: 16/464,116

(22) PCT Filed: Nov. 25, 2016

(86) PCT No.: PCT/SE2016/051172
§ 371 (c)(1),
(2) Date: May 24, 2019

(87) PCT Pub. No.: WO2018/097775
PCT Pub. Date: May 31, 2018

(65) Prior Publication Data
US 2019/0383574 A1 Dec. 19, 2019

(51) Int. Cl.
*F41A 33/02* (2006.01)
*F41G 3/26* (2006.01)

(52) U.S. Cl.
CPC ..... *F41A 33/02* (2013.01); *F41G 3/265* (2013.01); *F41G 3/2655* (2013.01); *F41G 3/2688* (2013.01)

(58) Field of Classification Search
CPC ..... F41A 33/00; F41A 33/02; F41A 33/04; F41A 33/06; F41G 3/26; F41G 3/265; F41G 3/2655; F41G 3/2688
See application file for complete search history.

(56) References Cited

U.S. PATENT DOCUMENTS 3,927,480 A 12/1975 Robertsson
2002/0045999 A1 4/2002 Bollweg et al.
(Continued)

FOREIGN PATENT DOCUMENTS

CA 1132708 A 9/1982
EP 0082598 A1 6/1983

OTHER PUBLICATIONS

Extended European Search Report in corresponding European Application No. 16922318.7 dated Aug. 28, 2020 (7 pages).
(Continued)

*Primary Examiner* — Timothy A Musselman
(74) *Attorney, Agent, or Firm* — Sage Patent Group

(57) ABSTRACT

The present invention relates to a method 300 for facilitating simulation of a shot from a weapon, wherein the weapon is equipped with a laser device which works on the time-of-flight principle. The method comprises the step 310 of receiving an emitted coded laser pulse sequence from the weapon by a simulation device. The method further comprises the step 350 of transferring a returned coded pulse sequence which corresponds to the emitted coded laser pulse sequence back to the weapon by the simulation device. The simulation device is a range simulation device. The method further comprises the step of delaying 330 said transferring in relation to said receiving so that said delay is perceived by said weapon as a longer travel time of the emitted coded laser pulse sequence and the returned coded pulse sequence, respectively. The method further relates to a simulation device.

20 Claims, 3 Drawing Sheets

(56) References Cited

U.S. PATENT DOCUMENTS

| | | | |
|---|---|---|---|
| 2002/0197584 | A1 | 12/2002 | Kendir et al. |
| 2004/0135716 | A1 | 7/2004 | Wootton |

OTHER PUBLICATIONS

Urban Combat Advanced Training Technology (UCATT) Product Development Group; "Standard for UCATT Laser Engagement Interface"; Version 1.0; May 9, 2016; 98 pages.

International Search Report with Written Opinion in corresponding international application No. PCT/SE2016/051172 dated Jul. 5, 2017 (14 pages).

International Preliminary Report on Patentability in corresponding international application No. PCT/SE2016/051172 dated Jan. 14, 2019 (8 pages).

Third Party Observation in corresponding international application No. PCT/SE2016/051172 mailed Nov. 14, 2018 (2 pages).

SIMULATION DEVICE AND A METHOD FOR FACILITATING SIMULATION OF A SHOT FROM A WEAPON

CROSS-REFERENCE TO RELATED APPLICATIONS

This application is a U.S. National Stage application of PCT/SE2016/051,172, filed Nov. 25, 2016 and published on May 31, 2018 as WO/2018/097,775, all of which is hereby incorporated by reference in their entity.

TECHNICAL FIELD

The present disclosure relates to a method for facilitating simulation of a shot from a weapon and to a simulation device for simulation of a shot from a weapon.

BACKGROUND ART

Training with some kind of weapons can be quite expensive. As an example, training with an ordinary shoulder-fired anti-tank missile would be expensive, partly due to the cost of the missile, and partly due to the cost for destroying the target. It is thus known to replace the "real" weapon with a corresponding weapon which is adapted for training purposes. The "real" shot is then often simulated by the corresponding weapon with a laser. This has the big advantage that the nothing is destroyed and no missiles or other ammunition are consumed. When training, and correctly simulating the ballistics, however, a large area is needed. In principle, in case the "real" weapon operates over several hundreds of meters or a few kilometres, training with the corresponding training weapon will also require an area of several hundreds of meters or a few kilometres for giving the impression of training in reality. Attempts have been made to reduce the area needed. A known solution is to scale the targets with a certain factor, an often used example is 1:10, i.e. to a tenth of its size, and to use then a tenth of the distance to the target when simulating the weapon. This allows using smaller areas for training, but on the other hand it requires adopting the weapon. In case the target and the distance are scaled down, it is required to adapt the weapon so that the functioning of the weapon, such as the ballistics of the simulated missile/ammunition, is compensated for the scaled down situation. The ballistics might comprise the flying time. When training in full scale terrain, the scaling compensation in the weapon has to be removed. Thus the weapon has to be adapted again. This adapting of the training weapon to different scales is time consuming and might cause a wrong feeling for an operator of the weapon in case the adaption is not performed properly. Further, even a scaling down to a tenth or so still requires considerably space.

There is thus a need for simulating weapons in scaled down situations without any need to adapt the weapon.

SUMMARY OF THE INVENTION

It is an objective of the present disclosure to allow training of weapons with a laser device so that no adapting of the weapon is needed when simulating in scaled situations.

It is an objective of the present disclosure to allow training of weapons with a laser device in such a way that the training can be performed indoors.

It is an objective of the present disclosure to present an alternative way for training with a weapon with a laser device.

At least some of the objectives are achieved by a method for facilitating simulation of a shot from a weapon, wherein the weapon is equipped with a laser device which works on the time-of-flight principle. The method comprises the step of receiving an emitted coded laser pulse sequence from the weapon by a simulation device. The method further comprises the step of transferring a returned coded pulse sequence which corresponds to the emitted coded laser pulse sequence back to the weapon by the simulation device. The simulation device is a range simulation device. The method further comprises the step of delaying said transferring in relation to said receiving so that said delay is perceived by said weapon as a longer travel time of the emitted coded laser pulse sequence and the returned coded pulse sequence, respectively.

This has the advantage that no adaptions have to be performed at the weapon. It will be possible to operate all functions of the weapon, including simulation of shots, as if the target would be at a much larger distance, without the need of any adaption of the weapon. Further this allows performing simulated training in much shorter areas. Especially this allows performing simulated training inside of buildings instead of the requirement to be outside for having enough space for simulation. This can thus reduce training costs significantly without affecting the appearance of the operation of the weapon.

In one example the emitted coded laser pulse sequence is pulse-coded. Pulse-coded pulse sequences are often used for weapon simulation. Thus the method will be operable with a lot of weapons which are already on the market.

In one example the returned coded pulse sequence which corresponds to the emitted coded laser pulse sequence is the emitted coded laser pulse sequence. This has the advantage that no conversions of the pulses have to be performed.

In one example, the method further comprises the step of decoding the emitted coded laser pulse sequence by the range simulation device. This allows an electrical implementation of the method. An electrical implementation allows for an especially small device when implementing the method on a simulation device.

In one example, the method further comprises the step of producing the returned coded pulse sequence by the range simulation device.

In one example, the delaying is performed such that the weapon perceives the returned coded pulse sequence as if it was transferred from a target at a larger distance in relation to the weapon than the distance of the range simulation device. This especially assures that no adaptions whatsoever need to be performed at the weapon.

In one example, the longer travel time corresponds to at least 200 metres, preferably to at least 500 metres, more preferably to at least 1 km, or even more preferably to at least 3 km. This provides for larger saving in area requirements.

At least some of the objectives are achieved by a simulation device for simulation of a shot from a weapon which is equipped with a laser device which works on the time-of-flight principle. The simulation device comprises a receiving arrangement which is arranged to receive an emitted coded laser pulse sequence from the weapon. The simulation device further comprises a transferring arrangement which is arranged to transfer a returned coded pulse sequence corresponding to the emitted coded laser pulse sequence back to the weapon. The simulation device is a range simulation device and further comprises a delaying unit. The delaying unit is arranged to delay the transferring in relation to the receiving so that the delay is perceived by the weapon as a longer travel time of the emitted coded pulse sequence and the returned coded pulse sequence.

This has the advantage that no adaptions have to be performed at the weapon. It will be possible to operate all functions of the weapon, including simulation of shots, as if the target would be at a much larger distance, without the need of any adaption of the weapon. Further this allows performing simulated training in much shorter areas. Especially this allows performing simulated training inside of buildings instead of the requirement to be outside for having enough space for simulation. This can thus reduce training costs significantly without affecting the appearance of the operation of the weapon.

In one embodiment, the receiving arrangement is arranged to receive emitted pulse-coded laser pulse sequences. The transferring arrangement is arranged to transfer returned pulse-coded pulse sequences. Pulse-coded pulse sequences are often used for weapon simulation. Thus the device will be operable with a lot of weapons which are already on the market.

In one embodiment, the receiving arrangement is arranged to receive emitted laser pulse sequences coded according to the OSAG-standard. The transferring arrangement is arranged to transfer returned pulse sequences coded according to the OSAG-standard. This standard is used by many countries. Thus the device will be operable with a lot of weapons which are already on the market.

In one embodiment, the delaying unit is an optical fibre. This requires no conversion of pulse sequences in the simulation device and thus allows an especially robust and easy construction of the simulation device.

In one embodiment, the receiving arrangement comprises a laser pulse decoding unit which is arranged to decode the received emitted coded laser pulse sequence. This allows processing the pulse sequence electronically in the simulation device.

In one embodiment, the transferring arrangement comprises a pulse sending unit which is arranged to send the returned coded pulse sequence.

In one embodiment, the pulse sending unit comprises a laser. This requires low power at the device and allows for producing a returned pulse sequence in the device which can resemble the received pulse sequence to a very high degree.

In one embodiment, the pulse sending unit comprises a light emitting diode. This makes construction cheap. It skips the requirement of performing a laser classification of the simulation device and increases its safety as it might lower the risk of eye damages for an operator of the weapon and/or the device.

In one embodiment, the receiving unit comprises a field-programmable gate array. This allows an easy adaption of the device to different situations.

In one embodiment, the delaying unit comprises an adjusting arrangement which is arranged for adjusting the time of the delay. This allows easy adaption of different distances which are simulated.

In one embodiment, the device further comprises a command receiving unit which is arranged to receive commands from a simulation system. This allows an automated system for simulation.

In one embodiment, the delaying is performed such that the weapon perceives the returned coded pulse sequence as if it was transferred from a target at a larger distance in relation to the weapon than the distance of the range simulation device.

BRIEF DESCRIPTION OF THE DRAWINGS

For a more detailed understanding of the present invention and its objects and advantages, reference is made to the following detailed description which should be read together with the accompanying drawings. Same reference numbers refer to same components in the different figures. In the following.

DETAILED DESCRIPTION

In the following, the description relates to pulses, such as in "coded pulse", "laser pulse", or the like. It should be understood that this throughout the description is a short hand notation for pulse sequence, i.e. for "coded pulse sequence", "laser pulse sequence", or the like.

Figure 1:
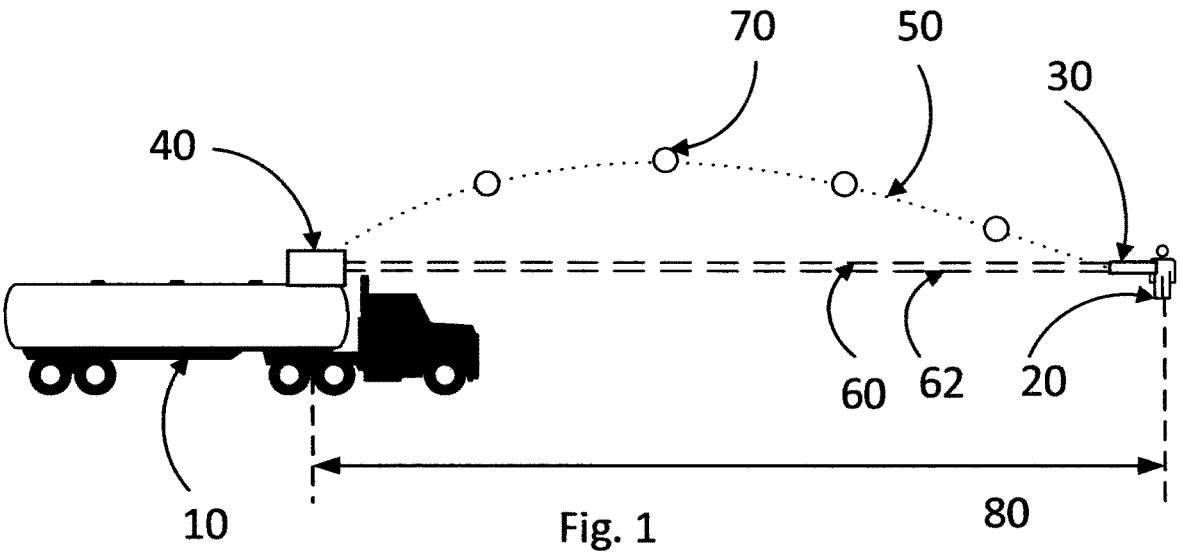
FIG. 1 shows, in a schematic way, a situation where simulation of a shot from a handheld weapon is simulated.

FIG. 1 shows, in a very schematic way, a situation where a simulation of a shot from a handheld weapon 30 is simulated. The handheld weapon 30 is carried by an operator 20. The term handheld weapon relates to any kind of weapon which can be carried by an operator 30. Thus, this also includes, for example, weapons which are put on the shoulder or other parts of a human body during operation as long as at least one hand also holds a part of the weapon. Examples of handheld weapons are thus shoulder-fired anti-tank missiles, rifles, guns, pistols, and so on.

The handheld weapon should be fired on a target 10. In the shown example, the target 10 is a vehicle, exemplified as a fuelling vehicle. The vehicle can be any other kind of vehicle, such as a truck, a tank, a jeep, a howitzer, a sea-borne vehicle, an aerial vehicle, or the like. The target 10 can be any other kind of target such as a person, a building, a construction, or the like. The target 10 is placed at a distance 80 from the operator 30 and the weapon 20. The distance 80 is in general much higher in relation to the size of the operator 20 and the target 10 as indicated in the picture. The distance 80 might be in the order of a few hundred of metres or a few kilometres. In the shown example the weapon is oriented to the front of the target. However, the weapon can be oriented towards any side of the target, such as a side of the target, the back of the target, the lower side of the target, or the like.

The weapon 30 is a training weapon which corresponds to a real weapon. The training weapon is usually designed to resemble the real weapon so that the operator has a feeling when operating training weapon that resembles the feeling of operating the real weapon. The weapon 30 is equipped with a laser device. In general, when triggering the weapon, a laser pulse 60 is emitted from the weapon. This laser device is in general arranged to emit a laser pulse 60 in the direction in which a real shot of the weapon would be emitted. In the shown example, the weapon is oriented towards the target 10 and the laser pulse is emitted towards the target. The laser pulse 60 is in general a coded laser pulse. This will be explained in more detail in relation to FIG. 2. Usually, the emitted laser pulse which is emitted on triggering the weapon is a so-called zero code laser pulse. For training purposes, the target is equipped with a simulation device 40. This simulation device 40 is arranged to reflect a laser pulse back into the same direction where it came from. Thus the simulation device 40 is usually a retro-reflective mirror, or any other retro-reflecting arrangement. The simulation device 40 thus reflects the laser pulse 60 from the weapon 30 back to the weapon as a returned laser pulse 62. The weapon 30 is then arranged to determine the distance 80 between the weapon and the target bases on the time-of-flight principle. In other words, since the laser pulses 60 and 62 travel at the speed of light, by determining the time between emission of the laser pulse 60 and the detecting of the returned pulse 62 by the weapon, this time can be converted to the distance 80. By detecting the returned pulse 62 the weapon also analyses whether the returned pulse corresponds to the emitted pulse 60. This analysis can comprise detecting whether the returned pulse is at the same wavelength as the emitted pulse. This analysis can comprise detecting whether the returned pulse has the same code as the emitted pulse. The analysis is in general performed in such a way that light from another light source is excluded. As an example, by analysing whether the returned pulse has the same code as the emitted code, it can be excluded that the weapon erroneously assumes sun light as a returned pulse.

In one example, the weapon 30 is then arranged to simulate a shot from the weapon to the target 10. This shot has in general a non-straight trajectory 50 due to gravitational forces acting on the ammunition. Knowing the distance 80 to the target, the weapon 30 can simulate the trajectory 50 of the shot. The weapon 30 can be arranged to determine the position of the emitted ammunition in certain time steps. The positions of the emitted ammunition will follow the trajectory of the shot 50. This has been indicated by four positions 70 of the ammunition in the figure, of which only one position has a reference number for not overloading the figure. When simulating the position 70, this position 70 can, for example, be displayed in the sights of the weapon 30. Thus, the operator 20 of the weapon will be able to follow the simulated shot by seeing updated positions in the sights. In practice, there might be much more than four positions when simulating the shot. The operator might then be able to see in the sights whether the shot hits the target or not.

Usually, the zero code laser pulse is emitted as long as the shot is simulated. This is due to the fact that the shot might take a few or even more than ten seconds before it reaches the target due to limited speed of the ammunition. Thus the target might move during the travel time of the shot and, for example, be covered by a rock or the like before the shot arrives at the target. Since the laser pulse 60 will not be returned by the simulation device 40 on the target 10 in case the line of sight from the weapon to the target gets lost, the weapon can assure that the shot reaches the target by constantly, or intermittently at reasonable time-intervals, emitting the laser pulse 60 and detecting a returned pulse 62. In case the no pulse 62 is returned on simulated impact point it can be concluded that the shot did not reach the target. Another example is a moving target which changes position during the traveling time of the shot. By constantly, or intermittently at reasonable time-intervals, emitting the laser pulse 60 and detecting a returned pulse 62, the weapon will get updates of the distance 80 to the target and can conclude whether the shot has reached the target on impact point or whether the target has changed position in such a way that the shot on impact did not reach the target.

In one embodiment, the weapon is arranged to send upon calculated impact on target 10 a message to the target 10 that it is hit by a shot. This message can include information regarding used ammunition, regarding effect of the impact, or the like. This message is different from the zero code pulse and does not need to be returned to the weapon. On receiving this message the target will know whether it had been hit and can perform measures based on that, such as, for example, determining whether the simulated damage leads to a total loss. The weapon 30, on the other hand, can be arranged to give a message to the operator indicating whether the target had been hit, or, for example, how much the distance was between impact point and target, and/or, for example, the direction between impact point and target. This message to the operator can, for example, be a visual message or a voice message.

The situation which is depicted in FIG. 1 relates to a handheld weapon. The invention, however, is easily applicable to other kind of weapons, such as canons, or the like.

In a prior art solution which tried to lower the space requirements for weapon training, the target and the distance were down-scaled, for example 1:10, and the weapon was adapted so that the determined time in the time-of-flight calculation was compensated with a corresponding factor, for example multiplied by ten for the discussed 1:10 down-scaling example.

Figure 2:
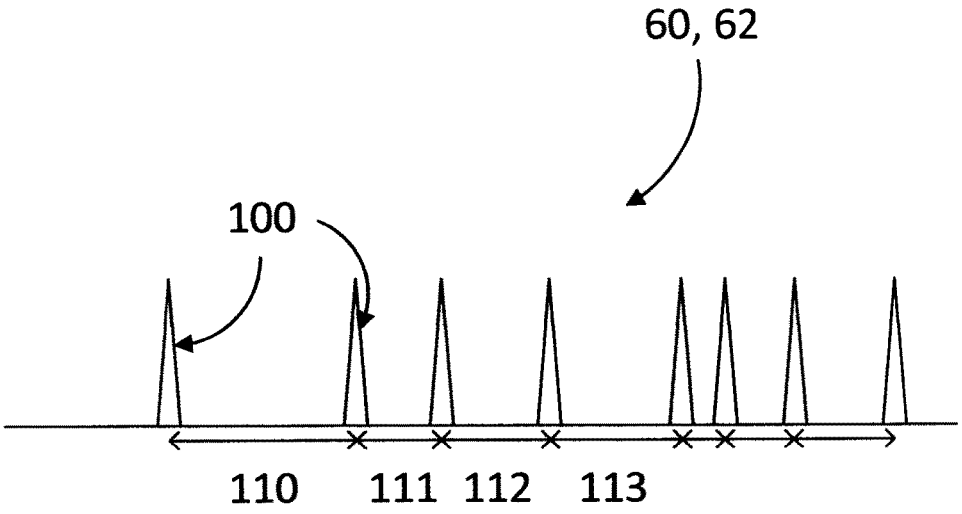
FIG. 2 shows, in a schematic way, an example of a coded laser pulse sequence from a weapon.

FIG. 2 shows, in a schematic way, an example of a coded laser pulse from a weapon. The shown example could be the laser pulse 60, and/or 62. In the horizontal direction of the figure, the time is depicted. In the vertical direction of the figure the laser power is depicted. The shown pulse is pulse-coded. As an example, peaks 100 are emitted after certain time intervals 110-113. The time intervals 110-113 can be in the order of several nanoseconds, tens of ns, or hundreds of ns. The time intervals 110-113 can differ in length. As an example, the four time intervals 110-113 can be 90 ns, 30 ns, 45 ns, and 60 ns. One laser pulse, such as a zero code pulse, preferably consists of a plurality of peaks 100 with time intervals 110-113. The number of time intervals can be more or less than those depicted in the FIG. In one example, the weapon 30 by determining the time intervals between the peaks in the returned pulse 62 can determine whether theses time intervals correspond to the emitted pulse 60. Thus the weapon can be arranged to determine whether the returned pulse 62 corresponds to the emitted pulse 60 or not.

In one example, the pulses are coded to the OSAG-standard (Optische Schnittstelle für AGDUS and GefÜbZ H), such as the OSAG 2.0 standard. However, in principle any other kind of standard, or any other kind of coding can be used as well. As an example, a coding can be performed by having different heights of the peaks in the plurality of peaks 100. The peaks are depicted as triangles. However, it should be emphasized that this is only for illustrative purposes. In general peaks in laser pulses can and will have different shapes than triangles.

It should also be understood that the coding, in principle, can be different than pulse-coding. In one example, the pulse sequence is coded by wavelength modulation. In one example, the pulse sequence is coded by amplitude modulation. The pulse sequence can be coded in any way.

Figure 3:
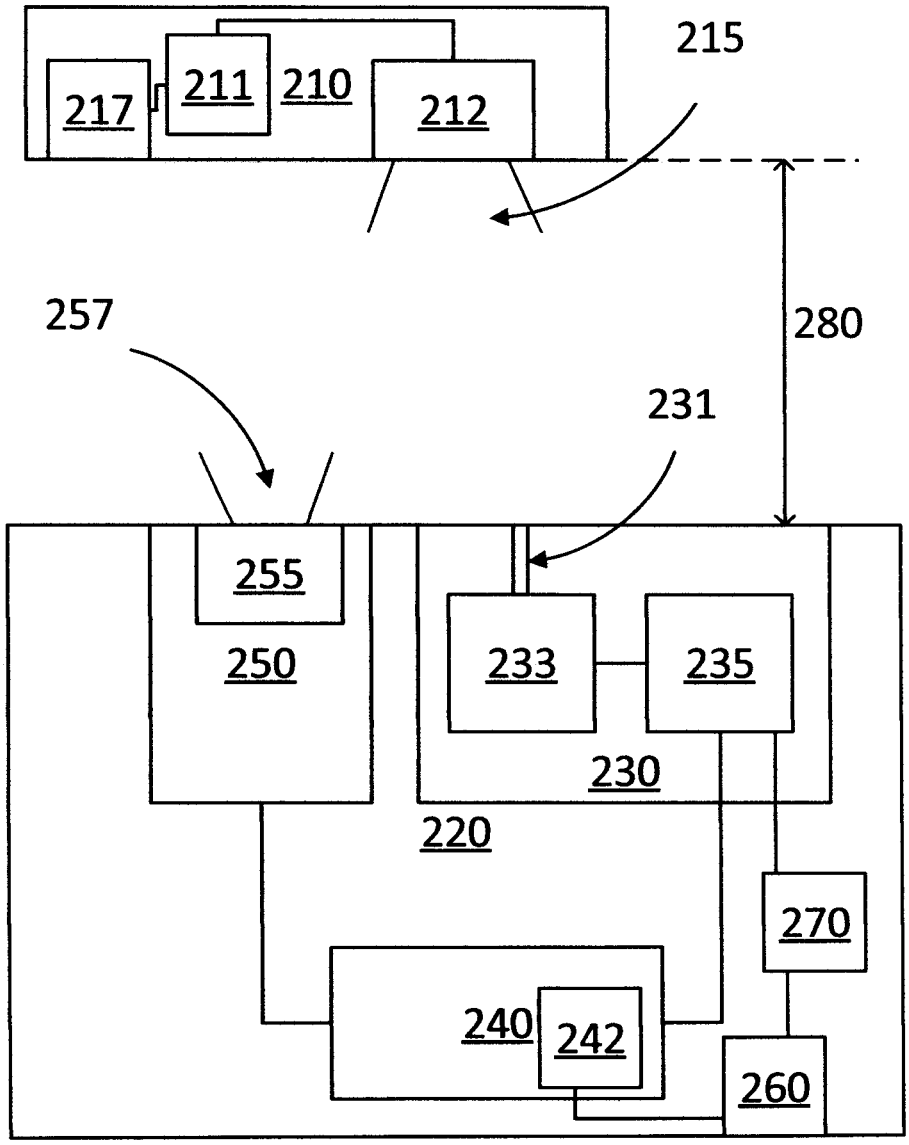
FIG. 3 shows, in a schematic way, an embodiment of a device according to the present disclosure.

FIG. 3 shows, in a schematic way, an embodiment of a device 220 according to the present disclosure. Also a weapon 210 is depicted schematically. This weapon can be a simulation weapon known in the art. It can be used in real-scale simulation such as those discussed in relation to FIG. 1. Thus the weapon 210 can be the weapon 30 from FIG. 1. The weapon 210 has a laser device 212. The laser device 212 is adapted to emit a coded laser pulse, which can be the laser pulse 60. The laser pulse can have a certain opening angle 215. The weapon can further comprise a receiver unit 217. The receiver unit can be adapted to receive light pulses. The weapon 210 can further comprise a control unit 211. The control unit 211 can be adapted to control the laser device 212 and/or the receiver unit 217. The laser device 212 can be adapted to emit a coded laser pulse on triggering the weapon. The control unit 211 and/or the receiver unit 217 can be arranged to analyse the received light pulse. The control unit 211 and/or the receiver unit 217 can be arranged to determine whether the received light pulse has a code sequence which corresponds to the code sequence of the emitted coded laser pulse. In one example, the control unit 211 and/or the receiver unit 217 are arranged to determine whether the received light pulse has the same code sequence as the code sequence of the emitted coded laser pulse.

The simulation device 220 is arranged to simulate a range. The simulation device comprises a receiving arrangement 230. The receiving arrangement is arranged to receive an emitted coded laser pulse. This coded laser pulse is emitted from the weapon 210. The emitted coded laser pulse can be a pulse-coded laser pulse. The emitted coded laser pulse can be coded according to the OSAG-standard. In one example the simulation device 220 is a simulation for facilitating simulation of a shot from a handheld weapon.

The receiving arrangement 230 can comprise a laser pulse decoding unit. The laser pulse decoding unit can be arranged to decode the received emitted coded laser pulse. The receiving arrangement can comprise an optical fibre 231. The optical fibre 231 can be arranged so that at least a part of the received emitted coded laser pulse can enter the optical fibre. The laser pulse decoding unit can comprise a laser chip 233. The optical fibre can be arranged to transport the laser pulse to the laser chip 233. In one example the coded laser pulse enters the laser chip 233 without passing an optical fibre. The laser chip 233 can be arranged to detect the laser pulse. The laser chip 233 can be arranged to convert the laser pulse. In one example the laser chip 233 is arranged to convert the laser pulse into a first electrical signal. The laser pulse decoding unit can comprise a decoder 235. The laser pulse decoding unit can be arranged to transfer the first electrical signal from the laser chip to the decoder 235. This can for example be achieved by electrical wires. The decoder 235 is preferably arranged to decode the first electrical signal. The decoder can comprise any kind of circuitry. The decoder 235 can comprise a field-programmable gate array, FPGA. The decoder 235 can be arranged to determine whether the decoded pulse fulfils a pre-determined condition or not. The pre-determined condition can relate to one or several code-sequences. As an example, the decoder 235 can be arranged to determine whether the decoded laser pulse corresponds to an accepted code sequence. In one example, the simulation device 220 comprises a code-storage 270. The code-storage 270 can be a memory element. The decoder 235 can be arranged to determine whether the decoded laser pulse corresponds to a code-sequence which is stored in the code-storage 270. The code-sequence(s) stored in the code-storage 270 can correspond to the accepted code sequence(s). The decoder 235 can be arranged to emit a second electrical signal to a delaying unit 240. In one example, the second electrical signal is only emitted in case the decoder has concluded that the decoded laser pulse corresponds to an accepted code sequence. In one example, the second electrical signal is not emitted in case the decoder has concluded that the decoded laser pulse corresponds not to an accepted code sequence. In one example the second electrical signal corresponds to the first electrical signal.

The simulation device further comprises a transferring arrangement 250. The transferring arrangement is arranged to transfer a returned coded pulse corresponding to the emitted coded laser pulse. The transferring arrangement is arranged to perform the transfer back to the weapon 210. In one example the returned coded pulse has a code-sequence which corresponds to the code-sequence of the emitted coded laser pulse from the weapon 210. In one example the returned coded pulse has a code-sequence which is the code-sequence of the emitted coded laser pulse from the weapon 210. The transferring arrangement 250 can be arranged to transfer returned pulse-coded pulses. The transferring arrangement 250 can be arranged to transfer returned pulse-coded pulses which are coded according to the OSAG-standard.

The transferring arrangement 250 can comprise a pulse sending unit 255. The pulse sending unit 255 can be arranged to send the returned coded pulse. The pulse sending unit 255 can comprise a laser. The pulse sending unit can comprise a light emitting diode, LED. The pulse sending unit can be arranged to receive a third electrical signal. The third electrical signal can originate from the delaying unit 240. In one example the third electrical signal corresponds to the second electrical signal. The pulse sending unit 255 can be arranged to produce the coded pulse based on the third electrical signal. The third electrical signal can comprise information regarding the code. As an example, a laser and/or a LED in the pulse sending unit 255 can be arranged to produce a coded signal which corresponds to the code which is transported by the third electrical signal.

The returned coded pulse can have an opening angle 257. Using a laser to produce the returned coded pulse has the advantage that a signal with a corresponding wavelength profile than the pulse which is emitted from the weapon can be easily produced. Using an LED has the advantage that no laser-classification of the simulation device 220 has to be performed before putting it in the market. Also, the device can be made safer in respect to a laser. Even further the opening angle 257 can be made bigger. When operating, the simulation device 220 will be placed at a distance 280 to the weapon, or more specifically to the laser device 212 of the weapon. This distance 280 is in one example between 1 and 10 metres, for example 5 metres. For such distances a LED is sufficient for producing enough light power so that the signal can be received at light intensity by the receiver unit 217 of the weapon. In one example, the opening angle 257 is constructed relatively large, such as at least 20 degrees in all directions, at least 40 degrees in all directions, at least 60 degrees in all directions, at least 90 degrees in all directions, or at least 120 degrees in all directions. This has the advantage that the device 220 can be oriented at different angles in relation to the weapon. In this way it is assured that the returned pulse still will be received by the weapon.

The receiving arrangement 230 can be arranged to block a short time period after having received a pulse. This assures that no reflexes of the transmitted pulses will reach the receiver and cause self-oscillations.

The simulation device 220 comprises a delaying unit 240. The delaying unit 240 is arranged to delay the transferring in relation to the receiving so that the delay is perceived by the weapon 210 as a longer travel time of the emitted coded pulse 60 and the returned coded pulse 62. In one example, the delaying unit 240 is arranged to keep the second electrical signal inside the delaying unit for a certain period of time. That certain period of time can be chosen in such a way that it corresponds to a travel time of the emitted coded pulse and the returned coded pulse which would correspond to a distance to the target as in the "real" case of FIG. 1. As an example, in case a target at a distance 80 of 3 km should be simulated, but the simulation device 220 is placed at a distance 280 of 5 m from the weapon, the second electrical pulse can be delayed in the delaying unit 240 for the time it would take for light to travel (3,000−5)*2 m=5,990 m through air. In this way the simulation device 220 simulates a longer range between the weapon and the target. The delay can be adapted for the further travel time of electrical and/or optical signals through other parts of the simulation device 220. However, the simulation device can be made very compact. In one example the simulation device 220 has outer dimensions in the order of one or a few centimetres. Thus this further travel time can be of no relevance as compared to the distances 280 and 80, respectively. However, in case a simulation device of bigger dimensions is constructed it might be practical to compensate for further travel time inside other parts of the device than the delaying unit. In one example, the delaying is performed such that the weapon 210 perceives the returned coded pulse as if it was transferred from a target at a larger distance in relation to the weapon than the distance 280 between the range simulation device and the weapon.

The delaying unit 240 can comprise any kind of delaying circuitry. In one example the delaying unit 240 comprises a FPGA.

In one example the delaying unit comprises an adjusting arrangement 242. The adjusting arrangement is arranged for adjusting the time of delay. In one example, the adjusting arrangement 242 is a resistance. In one example the adjusting arrangement comprises a memory and a controller. In one example the delaying unit is arranged to emit the third electrical signal after the delay. In one example the third electrical signal corresponds to the second electrical signal. In one example the third electrical signal is the second electrical signal.

One advantage of the simulation device 220 is that the weapon 210 does not need to be adapted. The weapon will receive pulses as if they have travelled the "real" distance 80 to the target and back, although the pulses only travelled the much shorter distance 280 to the simulation device 220 and back. The shot simulation as described in relation with FIG. 1 can still be performed with the corresponding travel time of the ammunition from weapon to impact as if it was the "real" distance 80. Even the shot simulation does not require any adaption of the weapon.

In one example, the delaying unit 240 is an optical fibre. The length of the optical fibre is preferably adapted to the distance which should be simulated. In this case no conversion into electrical signals has to be performed at the receiving arrangement 230. Further, no conversion from electrical to electrical signals has to be performed by the transferring arrangement 250. In this case the delaying unit 240 can be directly coupled to the receiving arrangement 230 and/or the transferring arrangement 250, respectively.

In one example the receiving arrangement 230 is or comprises a fibre collimator. In one example the transferring arrangement 250 is or comprises a fibre collimator.

In one example the simulation device 220 comprises a command receiving unit 260. The command receiving unit can be arranged to receive commands from a simulation system 290. The command receiving unit 260 can be arranged to receive commands regarding accepted code-sequences. The command receiving unit 260 can be arranged to update the stored codes in the code storage 270. The command receiving unit 260 can be arranged to receive commands regarding time and/or range adjustments of the simulation device 220. The command receiving unit 260 can be arranged to update the delay in the delaying unit, for example via the adjusting arrangement 242, based on the received commands.

Figure 4:
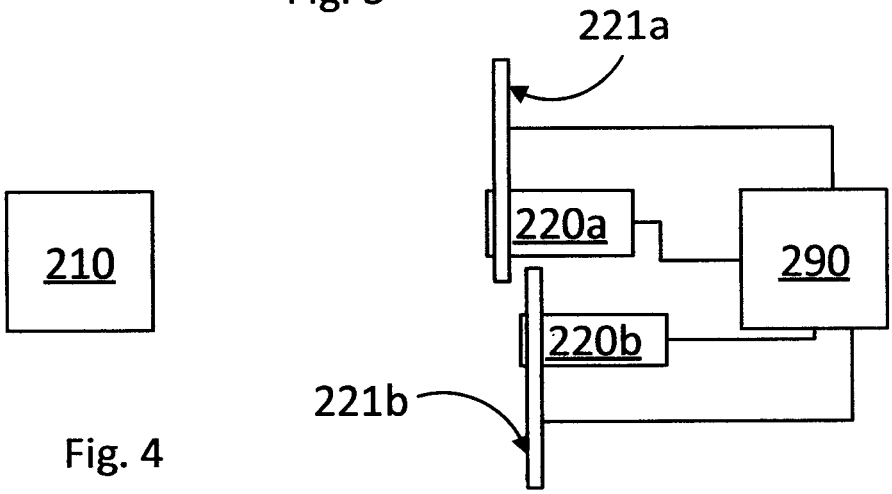
FIG. 4 shows, in a schematic way, a situation where a device according to the present disclosure is used.

FIG. 4 shows, in a schematic way, a situation where a device according to the present disclosure is used. The weapon 210 is schematically depicted. Two simulation devices 220*a*, 220*b*, as described in relation to FIG. 3 are depicted. In principle the number of simulation devices can be any number, such as one simulation device, two, or three simulation devices, or any other number of simulation devices. Each simulation can have a corresponding silhouette 221*a*, 221*b*. As an example the first simulation device 220*a* is arranged at a distance of 5 m to the weapon. The first simulation device can be arranged to simulate a tank at a distance of 3 km. Thus the first simulation device is arranged to simulate a travelling time of the coded laser pulse from the weapon through air of 5,990 m. If the real tank would have a length of 6 m, the corresponding first silhouette 221*a* which is adapted to the first simulation device has a length of 1 cm. The second simulation device 220*b* is arranged at a distance of 6 m to the weapon and should simulate a shed of 3 m height at 300 m distance. The corresponding second silhouette 221*b* can then have a size of 6 m and the second simulation device 220*b* can be arranged to simulate a travelling time of the coded laser pulse from the weapon through air of 588 m. The simulation devices and/or the corresponding silhouettes can be arranged to be movable. This has the advantage that even movable targets can be simulated. As an example, they can be equipped with wheels, mounted on rails, hang up by wires, or any other solution. A simulation system 290 can be provided to control the simulation devices. The simulation system 290 can be arranged to control the position and/or movement of the simulation devices. In one example the silhouettes can be displays or the like. The simulation system can then be arranged to change the image on the display. This can be performed so that different targets and/or targets at different distances are simulated.

Figure 5:
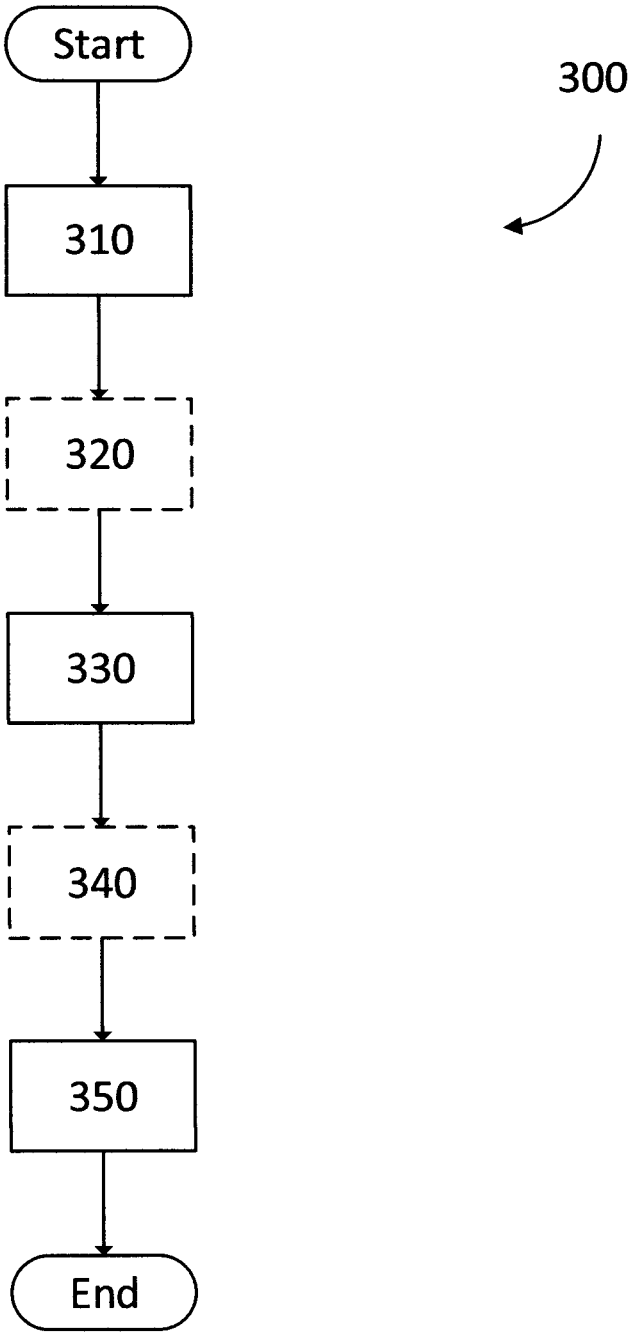
FIG. 5 shows, in a schematic way, a flowchart of a method according to the present disclosure.

FIG. 5 shows, in a schematic way, a flowchart of a method 300 according to the present disclosure. The method 300 is a method for facilitating simulation of a shot from a weapon, wherein the weapon is equipped with a laser device which works on the time-of-flight principle. In one example, the method 300 is a method for simulation of a shot from a handheld weapon. The method starts with the step 310.

In step 310 an emitted coded laser pulse from the weapon is received by a simulation device. The simulation device is a range simulation device. The simulation device can be the simulation device 210 described in relation to FIGS. 3 and 4. The received coded laser pulse can be pulse-coded. The method continues with the optional step 320.

In the optional step 320 the received emitted coded laser pulse is decoded by the range simulation device. This decoding can be performed by a decoder and/or a laser chip as described in relation to FIG. 3. The method continues with step 330.

In step 330 the transferring is delayed in relation to the receiving so that the delay is perceived by the weapon as a longer travel time of the emitted coded laser pulse and the returned coded pulse, respectively. The delaying is preferably performed so that that the weapon perceives the returned coded pulse as if it was transferred from a target at a larger distance in relation to the weapon than the distance of the range simulation device. In one example, the larger distance is at least 100 metres, preferably at least 250 metres, more preferably to at least 0.5 km, or even more preferably to at least 1.5 km.

In one example, the larger distance is at least a factor 2 larger than the distance of the range simulation device, preferably at least a factor 10 larger, more preferably at least a factor 100 larger. Thus it is possible to drastically reduce any space requirements between weapon and target without the need of performing adaptions at the weapon. The delaying can be physical delay without any conversion of the pulse. This can for example be achieved with the help of an optical fibre. The delaying can be an electronical delay. This can for example be achieved with simulation device as described in relation to FIG. 3. The method continues with the optional step 340.

In the optional step 340 the returned coded pulse is produced by the range simulation device. This can be performed by the pulse sending unit which is described in relation to FIG. 3. More specifically the returned pulse can, for example, be produced by a laser and/or a LED at the simulation device. The method continues with the step 350.

In step 350 a returned coded pulse corresponding to the emitted coded laser pulse is transferred back to the weapon by the simulation device. In one example the returned coded pulse corresponding to the emitted coded laser pulse is the emitted coded laser pulse. After step 350 the method ends.

In one example the method is used so that the larger distance is at least a factor 2 larger than the distance of the range simulation device, preferably at least a factor 10 larger, more preferably at least a factor 100 larger.

It should be understood that was has been described in relation to the method 300 can be performed by the simulation device described in relation to FIG. 1-4. Further, any of the functioning described in relation to any element of the simulation device in FIG. 1-4, or described in relation to any other object described in relation to FIG. 1-4, can be equally performed when executing the method 300. As an example, conversion from optical to electrical signals as described above can be performed as steps in relation to method 300 although only described in relation to FIG. 3. In other words, for example, functions of the simulation device 210 can be performed when performing the method 300, and/or the device 210 can be adapted to perform steps of the method 300.

The invention claimed is:

1. A method for facilitating simulation of a shot from a weapon, wherein the weapon is equipped with a laser device which works on the time-of-flight principle, the method comprising:

receiving an emitted coded laser pulse sequence from said weapon by a simulation device;

decoding said emitted coded laser pulse sequence by said range simulation device;

transferring a returned coded pulse sequence corresponding to said emitted coded laser pulse sequence back to the weapon by said simulation device, wherein said simulation device is a range simulation device and in that the method further comprises:

delaying said transferring in relation to said receiving so that said delay is perceived by said weapon as a longer travel time of the emitted coded laser pulse sequence and the returned coded pulse sequence, respectively.

2. The method according to claim 1, wherein said emitted coded laser pulse sequence is pulse-coded.

3. The method according to claim 1, wherein said returned coded pulse sequence corresponding to said emitted coded laser pulse sequence is said emitted coded laser pulse sequence.

4. The method according claim 1, further comprising producing said returned coded pulse sequence by said range simulation device.

5. The method according to claim 1, wherein said delaying is performed such that said weapon perceives said returned coded pulse sequence as if it was transferred from a target at a larger distance in relation to said weapon than the distance of said range simulation device.

6. The method according to claim 1, wherein said longer travel time corresponds to at least 200 metres, preferably to at least 500 metres, more preferably to at least 1 km, or even more preferably to at least 3 km.

7. Use of the method according to claim 6, so that said larger distance is at least a factor 2 larger than said distance of said range simulation device, preferably at least a factor 10 larger, more preferably at least a factor 100 larger.

8. A simulation device configured to simulate a shot from a training weapon which is equipped with a laser device which works on the time-of-flight principle, the simulation device comprising:

a receiving arrangement, being arranged to receive an emitted coded laser pulse sequence from said weapon;

wherein said receiving arrangement comprises a laser pulse decoding unit being arranged to decode said received emitted coded laser pulse sequence;

a transferring arrangement, being arranged to transfer a returned coded pulse sequence corresponding to said emitted coded laser pulse sequence back to the weapon;

wherein said simulation device is a range simulation device and further comprises:

a delaying unit, being arranged to delay said transferring in relation to said receiving so that said delay is perceived by said weapon as a longer travel time of the emitted coded pulse sequence and the returned coded pulse sequence.

9. The device according to claim 8, wherein said receiving arrangement is arranged to receive emitted pulse-coded laser pulse sequences, and wherein said transferring arrangement is arranged to transfer returned pulse-coded pulse sequences.

10. The device according to claim 8, wherein said receiving arrangement is arranged to receive emitted laser pulse sequences coded according to the OSAG-standard, and wherein said transferring arrangement is arranged to transfer returned pulse sequences coded according to the OSAG-standard.

11. The device according to claim 8, wherein said delaying unit is an optical fibre.

12. The device according to claim 8, wherein said transferring arrangement comprises a pulse sending unit that is arranged to send said returned coded pulse sequence.

13. The device according to claim 12, wherein said pulse sending unit comprises a laser.

14. The device according to claim 12, wherein said pulse sending unit comprises a light emitting diode.

15. The device according to claim 8, wherein said receiving unit comprises a field-programmable gate array.

16. The device according to claim 8, wherein said delaying unit comprises an adjusting arrangement being arranged for adjusting the time of said delay.

17. The device according to claim 8, further comprising a command receiving unit being arranged to receive commands from a simulation system.

18. The device according to claim 8, wherein said delaying is performed such that said weapon perceives said returned coded pulse sequence as if it was transferred from a target at a larger distance in relation to said weapon than the distance of said range simulation device.

19. A shot simulation system for simulating a shot from a training weapon on a target the system comprising:

a training weapon equipped with a laser device for emitting a laser pulse from the weapon when triggering the weapon, and a target equipped with a range simulation device according to claim 8.

20. Use of a range simulation device according to claim 8 in a shot simulation system for simulating a shot from a training weapon equipped with a laser device for emitting a laser pulse from the weapon when triggering the weapon.

* * * * *